US007556478B2

(12) United States Patent
Klein et al.

(10) Patent No.: US 7,556,478 B2
(45) Date of Patent: Jul. 7, 2009

(54) COMPRESSOR CONTROL APPARATUS

(75) Inventors: Christopher D. Klein, Cincinnati, OH (US); Brian T. Humpert, Cincinnati, OH (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 843 days.

(21) Appl. No.: 10/880,673

(22) Filed: Jun. 30, 2004

(65) Prior Publication Data

US 2006/0002800 A1 Jan. 5, 2006

(51) Int. Cl.
*F04B 49/06* (2006.01)
*F04B 49/00* (2006.01)

(52) U.S. Cl. ..... 417/44.2; 417/44.1; 137/116.3

(58) Field of Classification Search ..... 417/44.2, 417/44.1

See application file for complete search history.

(56) References Cited

U.S. PATENT DOCUMENTS

| | | | | |
|---|---|---|---|---|
| 3,834,837 | A | 9/1974 | Nickell | |
| 4,143,545 | A | 3/1979 | Sitabkhan | |
| 4,333,491 | A * | 6/1982 | Knubley | 137/116.3 |
| 4,421,151 | A | 12/1983 | Stumpe | |
| 4,456,038 | A | 6/1984 | Gwaltney et al. | |
| 4,694,409 | A | 9/1987 | Lehman | |
| 5,040,563 | A | 8/1991 | Wood | |
| 5,125,800 | A | 6/1992 | Wong | |
| 5,307,846 | A | 5/1994 | Heinemann | |
| 5,516,379 | A | 5/1996 | Schultz | |
| 5,774,048 | A | 6/1998 | Achterholt | |
| 6,067,850 | A | 5/2000 | Lang et al. | |
| 6,148,888 | A | 11/2000 | Loureiro Benimeli | |
| 6,293,147 | B1 * | 9/2001 | Parker et al. | 73/462 |
| 6,516,707 | B2 | 2/2003 | Elberson | |
| 6,561,017 | B1 | 5/2003 | Claussen et al. | |
| 6,705,360 | B1 * | 3/2004 | Bonzer | 141/38 |
| 2004/0175273 | A1 * | 9/2004 | Dean et al. | 417/44.2 |

* cited by examiner

*Primary Examiner*—Charles G Freay
*Assistant Examiner*—Patrick Hamo
(74) *Attorney, Agent, or Firm*—Jones Day

(57) ABSTRACT

A control device is provided for use with a pneumatic pump for generating output pressure, a pressure sensor for indicating the level of the output pressure, and an input device for receiving a target pressure level input by a user. The control device is configured to monitor the sensed output pressure during a pressurizing condition in which the pump provides increasing output pressure. The control device is further configured to maintain the pressurizing condition while the level of the sensed output pressure increases past the target pressure level, and to terminate the pressurizing condition in response to the sensed output pressure increasing to a level that exceeds the target pressure level by a predetermined differential value.

32 Claims, 3 Drawing Sheets

COMPRESSOR CONTROL APPARATUS

TECHNICAL FIELD

This technology relates to compressors for providing pressurized gas, and particularly relates to a control device for use in such a compressor.

BACKGROUND

A compressor is used to provide pressurized gas to a pneumatic reservoir. The compressor includes a pneumatic pump that is driven by a motor. The pneumatic reservoir could be defined within a storage tank for storing the gas, or within an inflatable device such as a tire or the like. While the compressor is operating, the increasing pressure in the pneumatic reservoir can lag the output pressure at the pump. For example, a conduit may be used to connect the compressor to the pneumatic device. A pressure drop along the length of the conduit can cause the pressure in the pneumatic reservoir to lag the output pressure at the compressor in the amount of the pressure drop.

SUMMARY

The invention provides a control device. The control device is configured for use with a pneumatic pump for generating output pressure, a pressure sensor for indicating the level of the output pressure, and an input device for receiving a target pressure level input by a user.

Specifically, the control device is configured to monitor the sensed output pressure during a pressurizing condition in which the pump provides increasing output pressure. The control device is further configured to maintain the pressurizing condition while the level of the sensed output pressure increases past the target level, and to terminate the pressurizing condition in response to the output pressure increasing to a level that exceeds the target level by a predetermined differential value.

In the example described below, the predetermined differential value corresponds to a predetermined dynamic pressure drop in a conduit for transmitting the output pressure to a pneumatic reservoir.

DESCRIPTION

Figure 1:
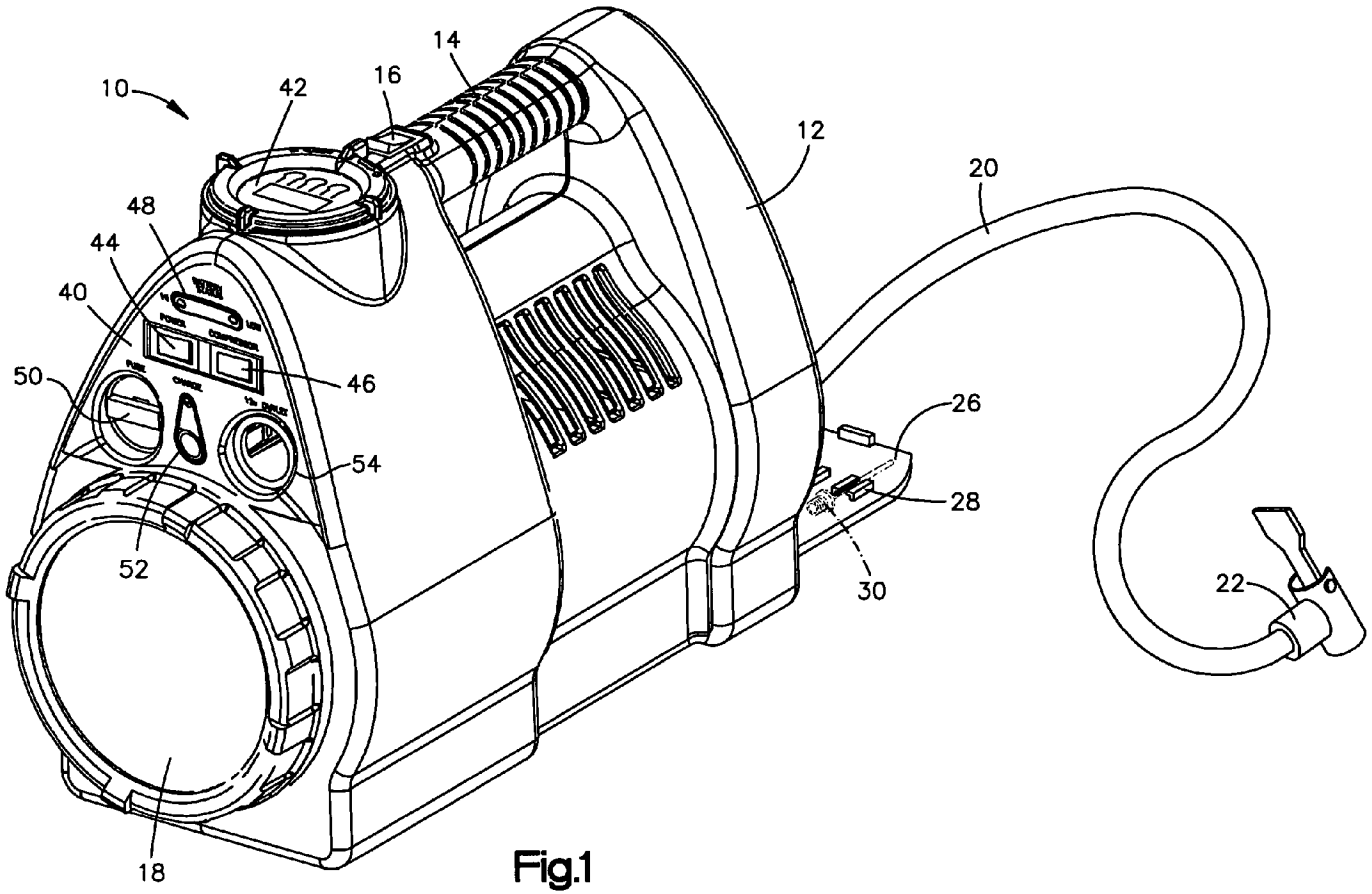
FIG. 1 is a front perspective view of a portable air compressor.
Figure 2:
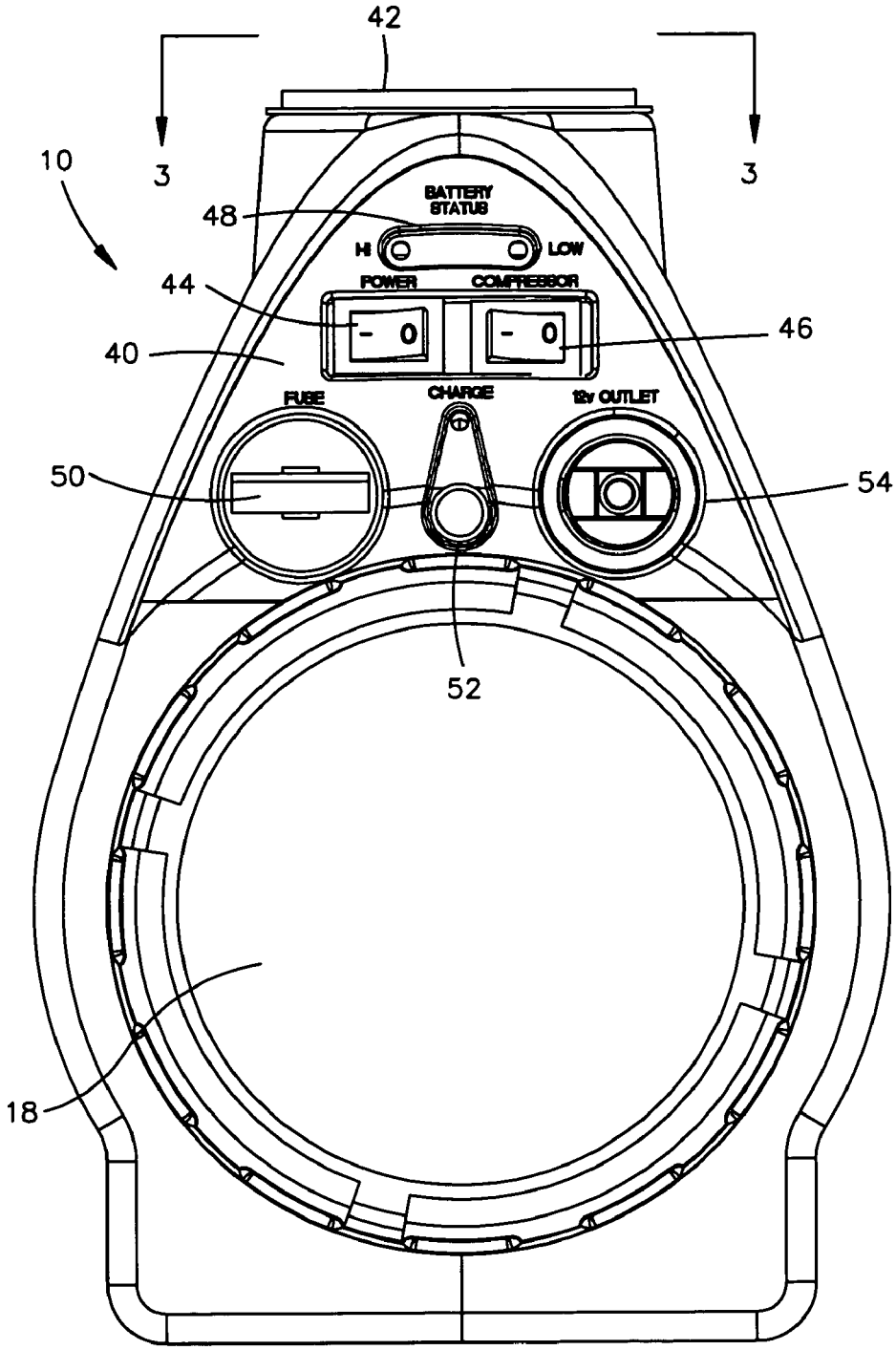
FIG. 2 is a front view of the compressor.

The apparatus 10 shown in FIG. 1 has parts that are examples of the elements recited in the claims. This particular apparatus 10 is a portable air compressor for inflating tires or other inflatable devices.

The compressor 10 has a plastic housing 12 with a handle 14. A thumb switch 16 is accessible from the handle 14 to operate a lamp 18 at the forward end of the housing 12. A pneumatic hose 20 extends from the rear of the housing 12. The hose 20 has a clamp 22 for engaging a valve stem on the inflatable device, and can be coiled for storage within the housing 12 behind a door 26 which, as shown in FIG. 1, has clasps 28 for holding fittings 30. A forward control panel 40 is located at the forward end of the housing 12. An upper control panel 42 is located at the top of the housing 12.

The forward control panel 40 has a power switch 44 and a compressor switch 46. A battery status indicator 48, with "high" and "low" LEDs, is located on the forward panel 40 above the switches 44 and 46. A fuse 50, a socket 52 for a battery charger, and a 12-volt outlet 54 are located on the forward panel 40 below the switches 44 and 46.

Figure 3:
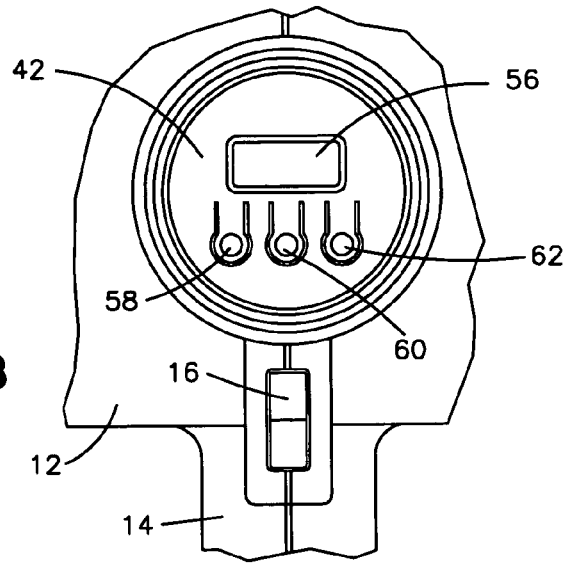
FIG. 3 is a partial top view of the compressor taken on line 3-3 of FIG. 2.

As best shown in FIG. 3, the upper control panel 42 at the top of the housing 12 includes a pressure display device in the form of an LCD 56. The upper panel 42 further includes a row of three input devices in the form of adjustment buttons 58, 60 and 62. Like the lamp switch 16, the adjustment buttons 58, 60 and 62 are accessible from the handle 14 for actuation by the user's thumb.

Figure 4:
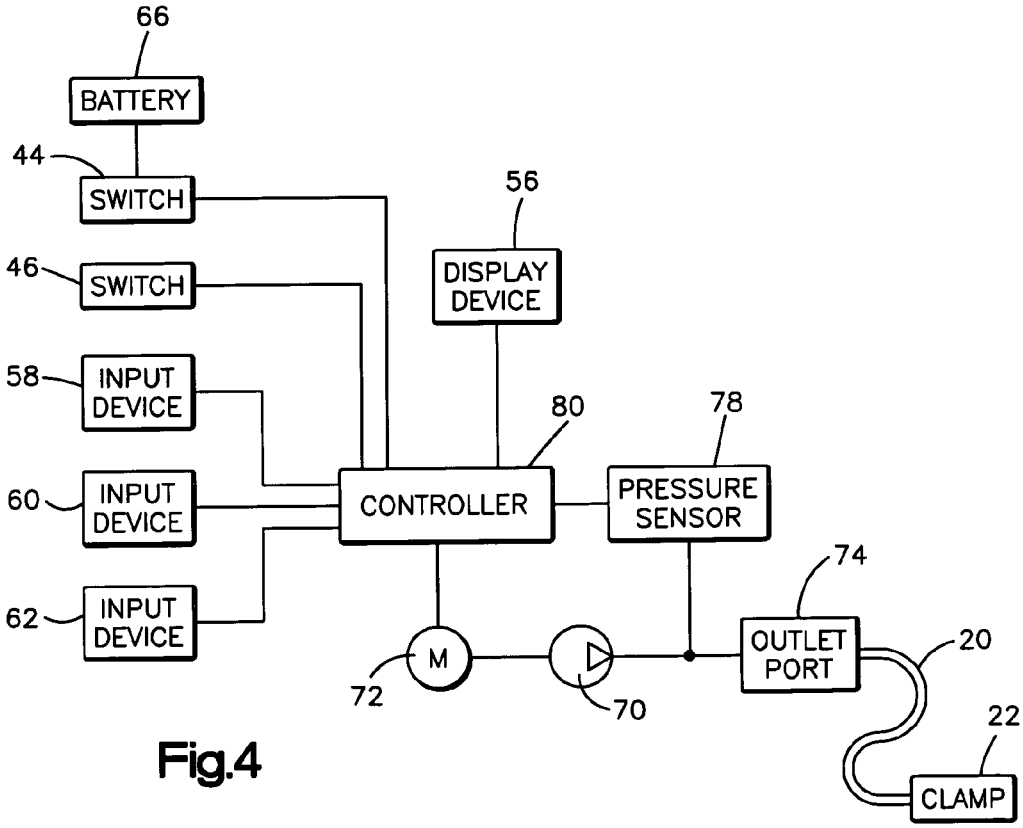
FIG. 4 is a schematic diagram of parts of the compressor.

Several parts of the compressor 10 are shown schematically in FIG. 4. These include a battery 66, a pneumatic pump 70 with a motor 72, and an outlet port 74. A pressure sensor 78 is operative to indicate the pressure at the outlet port 74. The hose 20 communicates the outlet port 74 with the clamp 22. Also shown schematically in FIG. 4 is a control device in the form of a controller 80. The various parts shown in FIG. 4 are operatively interconnected to provide compressed air to the inflatable device under the influence of the controller 80.

The user begins an inflating process by first turning on the power switch 44 at the forward control panel 40. This provides the upper control panel 42 with power from the battery 66. Power can alternatively be provided from the outlet 54 (FIG. 1) if a connector is plugged into the outlet 54 from a vehicle cigarette lighter or other source. The user then depresses the first adjustment button 58 to select a pressure scale by scrolling through selections made available on the display 56 by the controller 80. The user next inputs a target pressure level for the inflatable device. This is accomplished by depressing the second adjustment button 60 to decrease the target pressure level digitally indicated on the display 56, and by depressing the third adjustment button 62 to increase that level until the desired target pressure level appears on the display 56.

When the target pressure level has been set, the user attaches the clamp 22 to the valve stem on the inflatable device, and turns on the compressor switch 46 at the forward control panel 40. The controller 80 responds by starting the motor 72 and the pump 70. This begins a pressurizing condition in which the pump 70 provides dynamic air pressure to the outlet port 74 for transmission to the inflatable device through the hose 20 and the clamp 22.

As the pressure in the inflatable device increases toward the target pressure level, the dynamic pressure at the outlet port 74 also increases. The controller 80 monitors the dynamic pressure, as indicated by the sensor 78, and maintains the pressurizing condition until the increasing dynamic pressure reaches a level which, as interpreted by the controller 80, indicates that the pressure in the inflatable device has reached the target level that was input by the user. The controller 80 operates to provide the target pressure in the inflatable device in this manner by compensating for a dynamic pressure drop that occurs along the length of the hose 20 during the pressurizing condition. The value of the pressure drop depends on factors that include the size of the hose 20 and the flow rate of compressed air that the pump 70 provides to the outlet port 74. The controller 80 compensates for the pressure drop in the hose 20 by maintaining the pressurizing condition while the level of the sensed dynamic pressure increases past the target level, and by subsequently terminating the pressurizing condition when the sensed dynamic pressure increases to a level that exceeds the target level by a predetermined differential value. The differential value corresponds to the pressure drop in the hose 20. More specifically, the differential value comprises all or a portion of the pressure drop in the hose 20, and is preferably equal or approximately equal to the pressure drop so as to represent the effect of the pressure drop.

In a first mode of practicing the invention, the controller 80 compensates for the pressure drop by adding the corresponding differential value to the target pressure level that has been input by the user. The controller 80 thus determines an elevated pressure level that equals the sum of the differential value and the target level. The pressurizing condition is maintained while the sensed dynamic pressure increases past the target level, and is terminated when the sensed dynamic pressure increases to the elevated level.

For example, in the process of designing, assembling and testing a prototype of the compressor 10, it might be determined that a drop of 3 psi occurs along the length of the hose 20 from the dynamic pressure at the outlet port 74 to the dynamic pressure at the clamp 22. The compressor 10 would be equipped with a controller 80 that operates accordingly. In the first mode of practicing the invention, the controller 80 could use the predetermined pressure drop of 3 psi as the predetermined differential value to add to the target pressure level. In this example, if the target pressure level received by the input device 60 and/or 62 were 32 psi, the controller 80 would respond by determining an elevated pressure level of 35 psi. The controller 80 would maintain the pressurizing condition while the sensor 78 indicates that the dynamic pressure is increasing past the target level of 32 psi, and would subsequently terminate the pressurizing condition when the sensor 78 indicates that the dynamic pressure has increased to the elevated level of 35 psi. The pressure attained in the inflatable device would then match the target level of 32 psi because the pressure drop along the length of the hose 20 causes the dynamic pressure at the clamp 22 to be 3 psi less than the dynamic pressure at the outlet port 74.

The controller 80 preferably terminates the pressurizing condition by turning the motor 72 and pump 70 off. The compressor switch 46 in this example would be returned to the off position manually.

In a second mode of practicing the invention, the controller 80 considers a predetermined differential value of pressure that corresponds to the dynamic pressure drop in the hose 20, as in the first mode, but uses the differential value to determine a reduced pressure level rather than an elevated pressure level. Specifically, the controller 80 monitors the level of the dynamic pressure indicated by the sensor 78, and subtracts the predetermined differential value from the level of the sensed dynamic pressure. The controller 80 thus determines a pressure level that is reduced from the sensed dynamic pressure level in the amount of the pressure drop through the hose 20. The pressurizing condition is maintained by the controller 80 while the level of the sensed dynamic pressure increases past the target level, and is terminated by the controller 80 in response to the reduced pressure level increasing to the target level.

Using the example of a 3 psi pressure drop through the hose 20, the controller 80 would operate in the second mode of practicing the invention by monitoring the level of the dynamic pressure indicated by the sensor 78, and by determining and monitoring a corresponding reduced pressure level by subtracting 3 psi from the level of the sensed dynamic pressure as the sensed dynamic pressure increases. The pressurizing condition would be maintained by the controller 80 while the level of the sensed dynamic pressure increases past the target level of 32 psi. The pressurizing condition subsequently would be terminated by the controller 80 when the reduced pressure level increases to the target level of 32 psi. This would ensure that the pressure in the inflatable device reaches the target level of 32 psi because the reduced pressure level considered by the controller 80 effectively represents the dynamic pressure at the clamp 20 rather than the dynamic pressure at the outlet port 74.

The controller 80 may comprise any suitable configuration of one or more microprocessors that can process instructions from software, or other types of programs, such as firmware, to operate with reference to a predetermined differential value of pressure as described above. Preferably, the pressure display device 56 also operates with reference to the differential value. In the second mode of operation, this is preferably accomplished by displaying the value of the reduced pressure level, rather than the pressure level indicated by the sensor 78, on the display device 56 during the pressurizing condition. The same effect may be provided for the first mode of operation by calibrating the device 56 to display a pressure level that is less than the level of the dynamic pressure in the amount of the differential value. In each case, when the pressurizing condition is terminated, operation of the display device 56 reverts to a mode in which it displays the actual static pressure indicated by the sensor 78. This provides the user with a digital display of the actual static pressure in the inflatable device when that static pressure is transmitted back to the sensor 78 through the hose 20 without a dynamic pressure drop.

This written description sets forth the best mode of practicing the claimed invention, and describes the claimed invention to enable a person of ordinary skill in the art to make and use it, by presenting examples of the elements recited in the claims. The patentable scope of the claimed invention is defined by the language of the claims, and may include other examples that occur to those skilled in the art. Such other examples, which may be available either before or after the application filing date, are intended to be within the scope of the claims if they have elements that do not differ from the literal language of the claims, or if they have equivalent elements with insubstantial differences from the literal language of the claims.

The invention claimed is:

1. An apparatus for use with a pneumatic pump for generating output pressure, a conduit for transmitting the output pressure to a pneumatic reservoir, a pressure sensor for indicating the level of the output pressure, and an input device for receiving a target pressure level input by a user, the apparatus comprising:

a control device that is configured to:

(a) monitor the sensed output pressure during a pressurizing condition in which the pump provides increasing output pressure;

(b) maintain the pressurizing condition while the level of the sensed output pressure increases past the target pressure level; and (c) terminate the pressurizing condition in response to the sensed output pressure increasing to a level that exceeds the target pressure level by a predetermined differential value that corresponds to a predetermined dynamic pressure drop in the conduit.

2. An apparatus as defined in claim 1 wherein the predetermined differential value is equal or approximately equal to the predetermined dynamic pressure drop.

3. An apparatus as defined in claim 1 wherein the conduit comprises a hose.

4. An apparatus as defined in claim 1 wherein the control device is configured to terminate the pressurizing condition by turning off the pump.

5. An apparatus as defined in claim 1 further comprising a pressure display device that is operative in response to the sensed output pressure, and wherein the control device is configured for the pressure display device to display a pressure level that is less than the level of the sensed output pressure in the amount of the differential value.

6. An apparatus as defined in claim 5 wherein the control device is further configured for the pressure display device to display the actual level of a static pressure sensed by the pressure sensor when the pressurizing condition has been terminated by the control device.

7. An apparatus as defined in claim 1 wherein the control device is operatively interconnected with the pump, the conduit, the pressure sensor and the input device.

8. A portable air compressor including the apparatus of claim 7.

9. An apparatus for use with a pneumatic pump for generating output pressure, a conduit for transmitting the output pressure to a pneumatic reservoir, a pressure sensor for indicating the level of the output pressure, and an input device for receiving a target pressure level input by a user, the apparatus comprising:

a control device that is configured to:

(a) determine an elevated pressure level by adding a predetermined differential value to the target pressure level, wherein the predetermined differential value corresponds to a predetermined dynamic pressure drop in the conduit;

(b) monitor the sensed output pressure during a pressurizing condition in which the pump provides increasing output pressure;

(c) maintain the pressurizing condition while the level of the sensed output pressure increases past the target pressure level; and (d) terminate the pressurizing condition in response to the sensed output pressure increasing to the elevated pressure level.

10. An apparatus as defined in claim 9 wherein the predetermined differential value is equal or approximately equal to the predetermined dynamic pressure drop.

11. An apparatus as defined in claim 9 wherein the conduit comprises a hose.

12. An apparatus as defined in claim 9 wherein the control device is configured to terminate the pressurizing condition by turning off the pump.

13. An apparatus as defined in claim 9 further comprising a pressure display device that is operative in response to the sensed output pressure, and wherein the control device is configured for the pressure display device to display a pressure level that is less than the level of the sensed output pressure in the amount of the differential value.

14. An apparatus as defined in claim 13 wherein the control device is further configured for the pressure display device to display the actual value of a static pressure sensed by the pressure sensor when the pressurizing condition has been terminated by the control device.

15. An apparatus as defined in claim 9 wherein the control device is operatively interconnected with the pump, the conduit, the pressure sensor and the input device.

16. A portable air compressor including the apparatus of claim 1.

17. An apparatus for use with a pneumatic pump for generating output pressure, a conduit for transmitting the output pressure to a pneumatic reservoir, a pressure sensor for indicating the level of the output pressure, and an input device for receiving a target pressure level input by a user, the apparatus comprising:

a control device that is configured to:

(a) monitor the sensed output pressure during a pressurizing condition in which the pump provides increasing output pressure;

(b) determine and monitor a reduced pressure level by subtracting a predetermined differential value from the level of the sensed output pressure as the level of the sensed output pressure increases, wherein the predetermined differential value corresponds to a predetermined dynamic pressure drop in the conduit;

(c) maintain the pressurizing condition while the level of the sensed output pressure increases past the target pressure level; and (d) terminate the pressurizing condition in response to the reduced pressure level increasing to the target pressure level.

18. An apparatus as defined in claim 17 wherein the predetermined differential value is equal or approximately equal to the predetermined dynamic pressure drop.

19. An apparatus as defined in claim 17 wherein the conduit comprises a hose.

20. An apparatus as defined in claim 17 wherein the control device is configured to terminate the pressurizing condition by turning off the pump.

21. An apparatus as defined in claim 17 further comprising a pressure display device that is operative in response to the output pressure, and wherein the control device is configured for the pressure display device to display the reduced pressure level.

22. An apparatus as defined in claim 21 wherein the control device is further configured for the pressure display device to display the actual value of a static pressure sensed by the pressure sensor when the pressurizing condition has been terminated by the control device.

23. An apparatus as defined in claim 17 wherein the control device is operatively interconnected with the pump, the conduit, the pressure sensor and the input device.

24. A portable air compressor including the apparatus of claim 17.

25. An apparatus for use with a pneumatic pump for generating output pressure, a conduit for transmitting the output pressure to a pneumatic reservoir, a pressure sensor for indicating the level of the output pressure, and an input device for receiving a target pressure level input by a user, the apparatus comprising:

means for:

(a) monitoring the sensed output pressure during a pressurizing condition in which the pump provides increasing output pressure;

(b) maintaining the pressurizing condition while the level of the sensed output pressure increases past the target pressure level; and (c) terminating the pressurizing condition in response to the sensed output pressure increasing to a level that exceeds the target pressure level by a predetermined differential value that corresponds to a predetermined dynamic pressure drop in the conduit.

26. An apparatus as defined in claim 25 wherein the predetermined differential value is equal or approximately equal to the predetermined dynamic pressure drop.

27. An apparatus as defined in claim 25 wherein the conduit comprises a hose.

28. An apparatus as defined in claim 25 including means for terminating the pressurizing condition by turning off the pump.

29. An apparatus as defined in claim 25 further comprising means for displaying a pressure level that is less than the level of the sensed output pressure in the amount of the differential value.

30. An apparatus as defined in claim 29 including means for displaying the actual value of a static pressure sensed by the pressure sensor when the pressurizing condition has been terminated by the control device.

31. An apparatus as defined in claim 25 wherein the means for monitoring, maintaining and terminating is operatively interconnected with the pump, the conduit, the pressure sensor and the input device.

32. A portable air compressor including the means of claim 25.

* * * * *